US008006832B2

(12) United States Patent
Ateca

(10) Patent No.: US 8,006,832 B2
(45) Date of Patent: Aug. 30, 2011

(54) KEYPSAFE

(76) Inventor: Steven J. Ateca, Oak Park, IL (US)

( * ) Notice: Subject to any disclaimer, the term of this patent is extended or adjusted under 35 U.S.C. 154(b) by 99 days.

(21) Appl. No.: 12/350,988

(22) Filed: Jan. 9, 2009

(65) Prior Publication Data

US 2010/0176008 A1 Jul. 15, 2010

(51) Int. Cl.
*E05B 19/00* (2006.01)

(52) U.S. Cl. ..... 206/37.1; 206/38.1; 206/805

(58) Field of Classification Search ..... 206/37.1–37.8, 206/38.1, 37–38, 234, 477, 480–481; 70/456 R, 70/458–459, 456 B, 455
See application file for complete search history.

(56) References Cited

U.S. PATENT DOCUMENTS 3,882,704 A * 5/1975 Shanok et al. ..... 70/456 R
4,601,185 A * 7/1986 Sheldon ..... 70/456 R
5,440,910 A * 8/1995 Florian ..... 70/456 R
5,558,921 A * 9/1996 Pavlik ..... 428/121
5,944,080 A * 8/1999 Podwika ..... 150/147
6,082,160 A * 7/2000 Martyniak ..... 70/431
6,164,442 A * 12/2000 Stravitz ..... 206/233
2004/0003635 A1* 1/2004 Wright ..... 70/456 R
2005/0035005 A1* 2/2005 Thomas ..... 206/38.1

* cited by examiner

*Primary Examiner* — J. Gregory Pickett
*Assistant Examiner* — Robert Poon
(74) *Attorney, Agent, or Firm* — James Ray & Assoc

(57) ABSTRACT

A key cover for preventing intoxicated persons from driving a vehicle, such key cover comprises a generally U-shaped member formed of a first predetermined material and having a first elongated leg member having a first predetermined shape, a first predetermined length and a second elongated leg member formed of a second predetermined material and having a second predetermined shape, a second predetermined length. Such second predetermined length being shorter than the first predetermined length. Such second elongated leg member is substantially parallel to the first elongated leg member thereby forming a space therebetween for receiving a key portion of a car key. A means is disposed in such generally U-shaped member for preventing lateral movement of such key disposed between the first elongated leg member and the second elongated leg member. There is an aperture disposed on an outer portion of the second end of the first elongated leg member for receiving a key ring.

6 Claims, 3 Drawing Sheets

KEYPSAFE

FIELD OF THE INVENTION

The present invention relates, in general, to a car key device, and, more particularly, the present invention relates to device that can be affixed to a traditional car key to prevent intoxicated individuals from driving.

BACKGROUND OF THE INVENTION

Every year many people are injured or even killed by drunk drivers. Many people do not plan on drinking a large amount when they stop at a bar, but may end up doing so. Alcohol can impair the judgment of these individuals and can lead them to believe that they are sober enough to drive a car, when in reality they are under the influence and are not able to control a moving vehicle. Under these conditions the individual is not prepared for different emergencies that may occur or the individual may not see a pedestrian walking on the side of the road. The problems are further magnified if the individual drives very fast.

Thus, it would be advantageous if there were an apparatus that would prevent an individual who had been drinking from driving a car if that individual had too much to drink.

SUMMARY OF THE INVENTION

In a first aspect the present invention provides a key cover for preventing intoxicated persons from driving a vehicle, such key cover comprises a generally U-shaped member formed of a first predetermined material and having a first elongated leg member having a first predetermined shape, a first predetermined length and a first end and a second end and a second elongated leg member formed of a second predetermined material and having a second predetermined shape, a second predetermined length and having a first end and a second end. Such second predetermined length being shorter than the first predetermined length. Such second elongated leg member is substantially parallel to the first elongated leg member thereby forming a space therebetween for receiving a key portion of a car key. A means is disposed in such generally U-shaped member for preventing lateral movement of such key disposed between the first elongated leg member and the second elongated leg member. There is an aperture disposed on an outer portion of the second end of the first elongated leg member for receiving a key ring.

In a second aspect the present invention provides a key cover for preventing intoxicated persons from driving a vehicle. The key cover comprises a first elongated member which has a first predetermined shape and is formed of a first predetermined material, such first member having a first end and a second end and having an aperture disposed on an outer portion of the second end thereof for receiving a key ring. A second elongated member has a second predetermined shape and is formed of a second predetermined material, such second member being disposed substantially parallel to the first member and having a space therebetween for receiving a key portion of a vehicle key. There is a connecting portion that is engageable with the first end of the first member and with the first end of the second member for connecting the first member with the second member, such connecting portion having a predetermined shape. A notch member is formed on an outer surface and adjacent the second end of the second member. A third member has a third predetermined shape and is formed of a third predetermined material for engagement with the notch member for preventing such key disposed between such first member and such second member from being removed unless such key ring disposed in the aperture in such first member is first removed.

OBJECTS OF THE INVENTION

It is, therefore, one of the primary objects of the present invention to provide a means for preventing an intoxicated person from driving a car.

Another object of the present invention is to provide an apparatus wherein a car key is disposed in such apparatus and is locked in place and cannot be removed by an intoxicated person.

Still another object of the present invention is to provide an apparatus wherein such car key can be easily removed by a sober person.

Yet another object of the present invention is to provide an apparatus wherein a key ring of a vehicle key is engaged with the apparatus and which must be disengaged before the key can be removed from the apparatus.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

Figure 1:
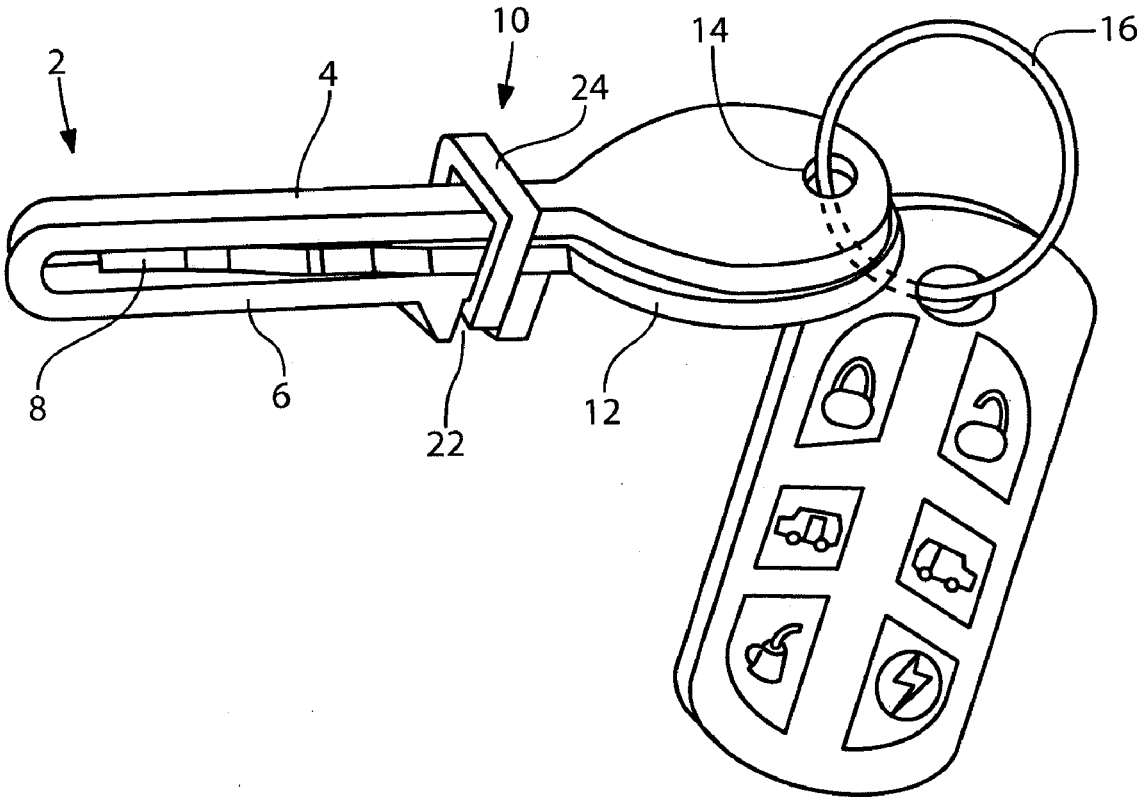
FIG. 1 is a side perspective view of the key cover for preventing an intoxicated person from driving a car according to an embodiment of the invention showing the key ring and the slip ring in place.
Figure 2:
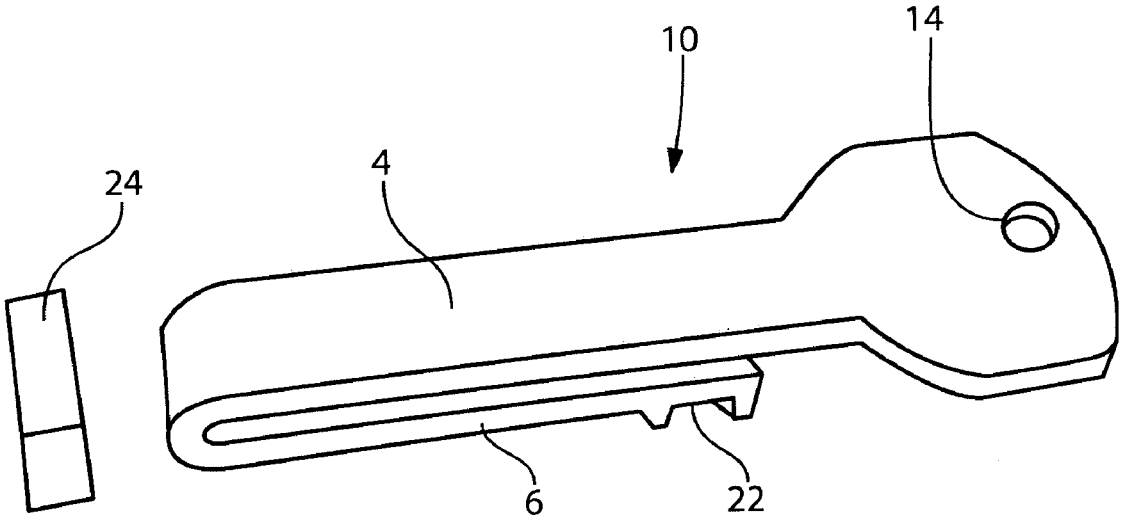
FIG. 2 is a side perspective view of the key cover without a key in place.
Figure 3:
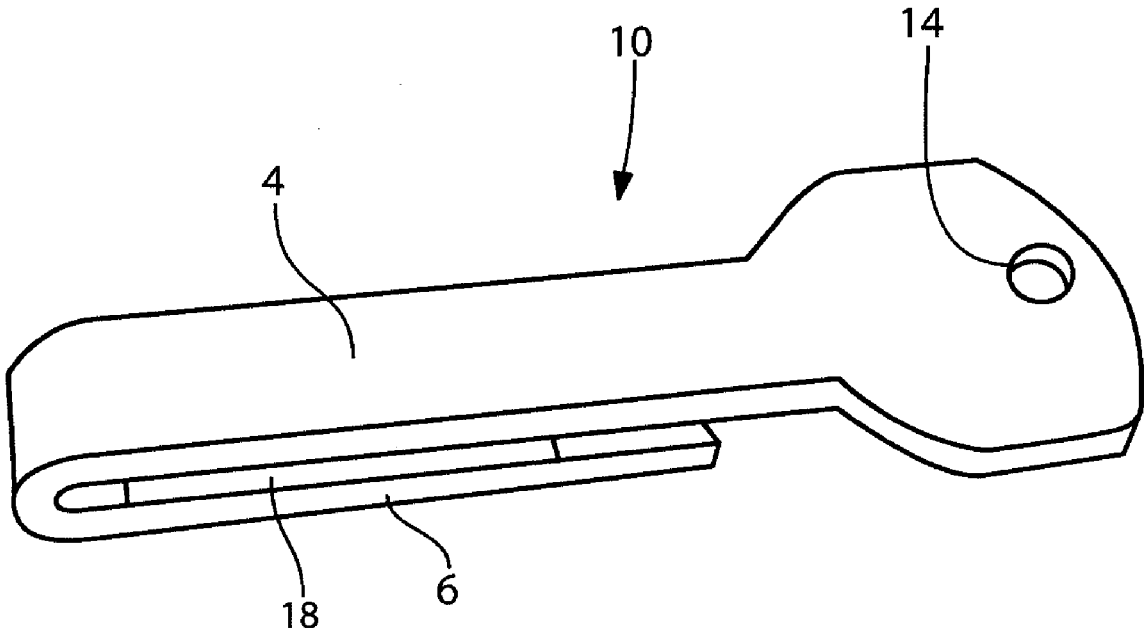
FIG. 3 is a side perspective view of the key cover showing an alternate embodiment for securing the key in place.
Figure 4:
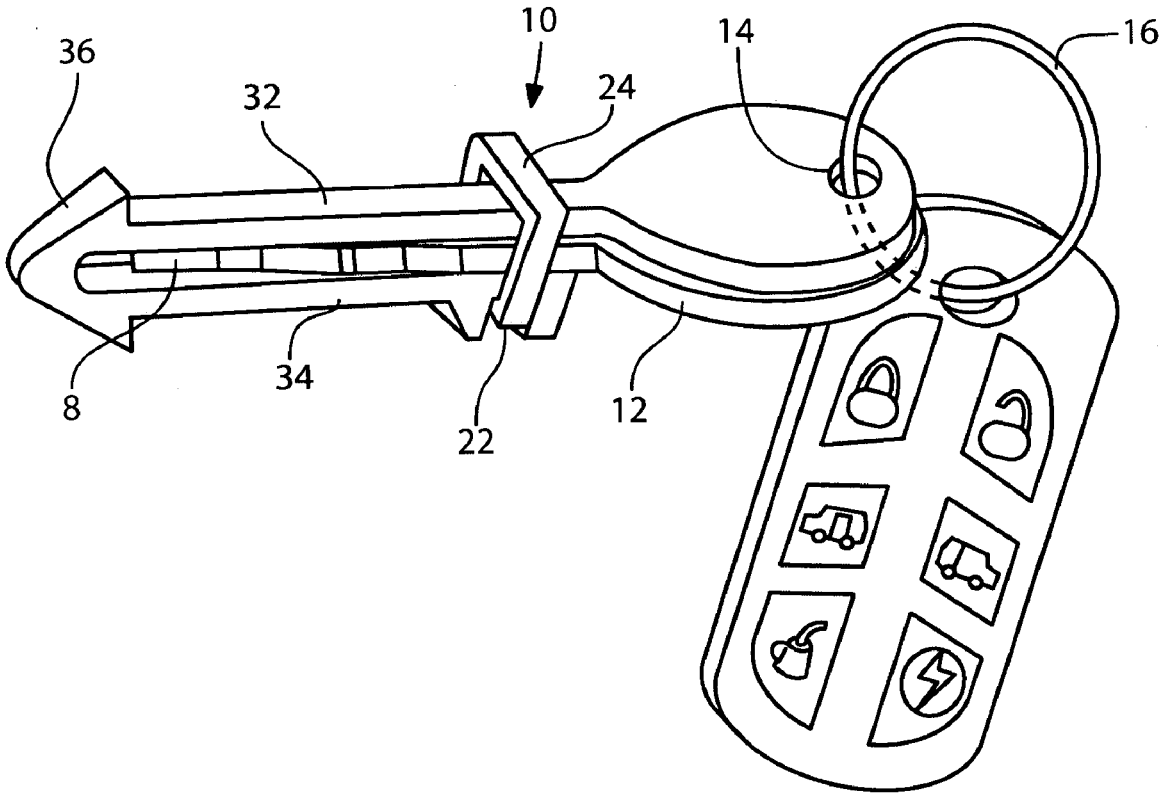
FIG. 4 is a side perspective view of the key cover according to an alternate embodiment of the invention showing the key locked in place.
Figure 5:
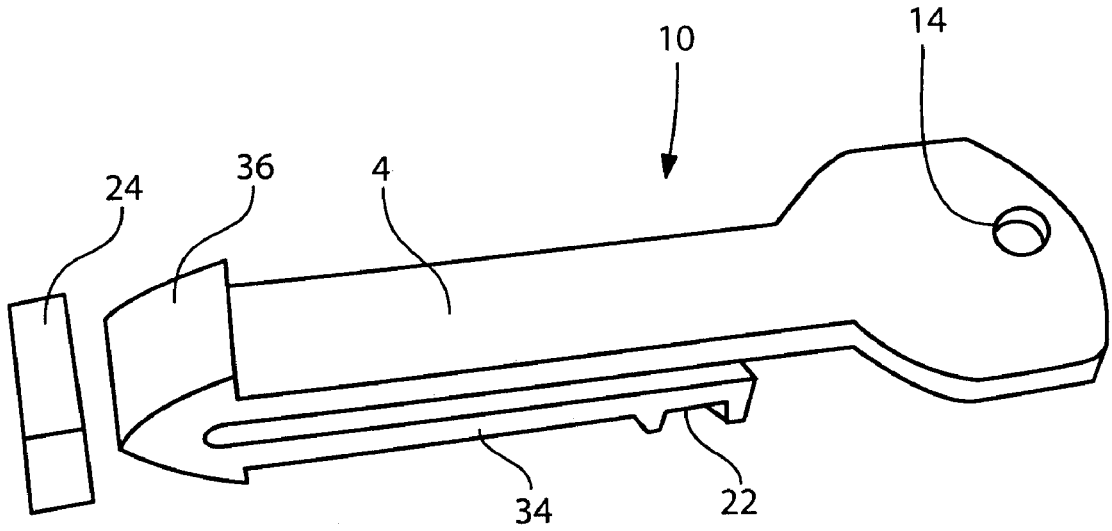
FIG. 5 is a side perspective view of the key cover according to an alternate embodiment of the invention.

BRIEF DESCRIPTION OF THE PRESENTLY PREFERRED AND VARIOUS ALTERNATIVE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides a key cover, generally designated 10, for preventing intoxicated persons from driving a vehicle. The key cover 10 comprises a generally U-shaped member 2 formed of a first predetermined material and having a first elongated leg member 4 having a first predetermined shape, a first predetermined length and a first end and a second end and a second elongated leg member 6 formed of a second predetermined material and having a second predetermined shape, a second predetermined length and having a first end and a second end. Such second predetermined length being shorter than the first predetermined length. Such second elongated leg member 6 is substantially parallel to the first elongated leg member 4 thereby forming a space therebetween for receiving a key portion 8 of a car key 12. A means, generally designated 20, is disposed in such generally U-shaped member 2 for preventing lateral movement of such key 12 disposed between the first elongated leg member 4 and the second elongated leg member 6. There is an aperture 14 disposed on an outer portion of the second end of the first elongated leg member 4 for receiving a key ring 16 of a vehicle key 12.

Such means 20 for preventing lateral movement of such key 8 disposed between the first elongated leg member 4 and the second elongated leg member 6 includes side walls 18 connecting outer portions of the first elongated leg member 4 and the second elongated leg member 6 thereby enclosing the space between the first elongated leg member 4 and the second elongated leg member 6.

The means 20 for preventing lateral movement of such key 12 disposed between the first elongated leg member 4 and the second elongated leg member 6 includes a notch member 22 formed adjacent a second end of the second elongated leg member 6.

Such means 20 for preventing lateral movement of such key 12 disposed between the first elongated leg member 4 and the second elongated leg member 6 when said key ring 16 is engaged with the aperture 14 disposed on such outer portion of the first elongated leg member 4 further includes a third member 24 for sliding over generally U-shaped member 2 and being further engageable with the notch member 22. Such third member 24 is a slip ring 24.

It is presently preferred that such first predetermined material is selected from one of metal and plastic. It is also preferred that such second predetermined material is substantially identical to the first predetermined material.

Such second end of the first elongated leg member 4 is shaped substantially like a handle portion of a vehicle key 12.

In a second aspect the present invention provides a key cover, generally designated 10, for preventing intoxicated persons from driving a vehicle. The key cover 10 comprises a first elongated member 32 having a first predetermined shape and being formed of a first predetermined material, such first member 32 having a first end and a second end and having an aperture 14 disposed on an outer portion of the second end thereof for receiving a key ring 16. A second elongated member 34 has a second predetermined shape and is formed of a second predetermined material, such second member 34 being substantially parallel to the first member 32 and having a space therebetween for receiving a key portion 8 of a vehicle key 12. There is a connecting portion 36 for engaging the first member 32 with the second member 34, such connecting portion 36 having a predetermined shape. A notch member 22 is formed adjacent a second end of the second member 34. A third member 24 has a third predetermined shape and is formed of a third predetermined material for engagement with the notch member 16 for preventing such key 12 disposed between such first member 32 and such second member 34 from being removed unless such key ring 16 disposed in the aperture 14 in such first member 32 is first removed.

Such third member 24 is a slip ring 24 for sliding over the connecting portion 36 and the first end of the first elongated member 32 and the second elongated member 34 and engaging the notch member 22 thereby locking the first elongated member 32 and the second elongated member 34 in place with such car key 12 disposed in the hollow portion and preventing such car key 12 from being removed while the third member 24 is locked in the notch 22 and such key ring 16 is engaged with the aperture 14 disposed in the first elongated member 24.

It is presently preferred that such connecting member 36 is formed integral with the first elongated member 32 and the second elongated member 34. It is also preferred that such first predetermined material is selected from one of metal and plastic and also preferred that such second and such third predetermined materials are substantially identical to the first predetermined material. It is also preferred that such second end of the first member 32 is shaped substantially like the handle portion of a key 12 and that the predetermined shape of the connecting member 36 is a V-shape.

Thus, the present invention provides an apparatus that can easily attach to a vehicle key to prohibit an inebriated person from driving. The apparatus is comprised of two components The first component is has a U shape or a V-shape. The apparatus has a hollow portion where the key portion of the vehicle key can be inserted. Once the key is completely housed within the apparatus a slip ring is pushed over the end of the apparatus and into place thereby locking the key in place. The other end of the apparatus has an aperture into which the key ring of the vehicle key is inserted. The key is now locked in place. For an individual who is not impaired removing the key is a simple matter. The key ring is removed from the apparatus and the key can be easily slid out of the apparatus. However, if the individual is impaired because he has imbibed too much then it is extremely difficult for that individual to remove the car key from the apparatus since the individual's motor skills are impaired.

Thus, the individual can prevent himself from driving while under the influence just by inserting the car key into the apparatus before drinking. If the individual stops before he/she is impaired then that individual would have no problem retrieving the car key and driving is not restricted. However, if the individual has had too much to drink by having the car key inserted into the apparatus can prevent that individual from driving and could save his/her life and possibly the life of an innocent person.

While a presently preferred embodiment and alternate embodiments of the present invention have been described in detail above, it should be understood that various other adaptations and/or modifications of the invention can be made by those who are particularly skilled in the art without departing from either the spirit of the invention or the scope of the appended claims.

I claim:

1. A key cover comprising:

(a) a first elongated member having a first predetermined shape, a first predetermined length and formed of a first predetermined material, said first member having a first end and a second end and having an aperture disposed on an outer portion of said second end thereof for receiving a key ring;

(b) a second elongated member having a first end and a second end and having a second predetermined shape, a second predetermined length and formed of a second predetermined material, said second predetermined length being shorter than said first predetermined length, said second member being disposed substantially parallel to said first member thereby forming a space therebetween for receiving a key portion of a car key;

(c) a connecting portion engaging said first end of said first member and said first end of said second member for engaging said first member with said second member, said connecting portion having a predetermined shape;

(d) a notch member formed on an outer surface and adjacent said second end of said second member;

(e) a slip ring having a third predetermined shape and formed of a third predetermined material engaging with said notch member and an outer surface of said first member for preventing such key disposed between said first member and said second member from being removed unless said slip ring is first removed.

2. The key cover, according to claim 1, wherein said connecting member is formed integral with said first elongated member and said second elongated member.

3. The key cover, according to claim 1, wherein said first predetermined material is selected from one of metal and plastic.

4. The key cover, according to claim 3, wherein said second and said third predetermined material are substantially identical to said first predetermined material.

5. The key cover, according to claim 1, wherein said second end of said first member is shaped substantially like a handle portion of a key.

6. The key cover, according to claim 1, wherein said predetermined shape of said connecting member is a V-shape.

* * * * *